US007780049B1

(12) United States Patent
Baranoski

(10) Patent No.: US 7,780,049 B1
(45) Date of Patent: Aug. 24, 2010

(54) BODY SUPPORT FOR A PORTABLE COMPUTER

(76) Inventor: James Baranoski, 36 Wheeler St., Waterbury, CT (US) 06704

( * ) Notice: Subject to any disclaimer, the term of this patent is extended or adjusted under 35 U.S.C. 154(b) by 0 days.

(21) Appl. No.: 12/347,327

(22) Filed: Dec. 31, 2008

(51) Int. Cl.
*A45F 3/14* (2006.01)

(52) U.S. Cl. ..... 224/250; 224/260; 224/638; 224/646; 294/149; 294/152; 211/117; 248/323

(58) Field of Classification Search ..... 224/250, 224/259, 260, 269, 638, 639, 646, 647, 651, 224/623; 294/149, 150, 77, 152, 155, 157; 211/117, 118; 248/323
See application file for complete search history.

(56) References Cited

U.S. PATENT DOCUMENTS

| | | | | | |
|---|---|---|---|---|---|
| 925,986 | A | * | 6/1909 | Blackburn | 294/157 |
| 1,500,510 | A | * | 7/1924 | McElvar et al. | 224/645 |
| 1,542,163 | A | * | 6/1925 | Morde | 224/646 |
| 2,441,115 | A | * | 5/1948 | Lambert | 224/259 |
| 2,535,683 | A | * | 12/1950 | Kimball | 224/159 |
| 3,116,948 | A | * | 1/1964 | Elsner | 294/74 |
| 3,120,403 | A | * | 2/1964 | Molzan et al. | 294/74 |
| 3,152,738 | A | * | 10/1964 | Worsfold, Jr. | 224/259 |
| 3,865,292 | A | * | 2/1975 | Foley | 294/149 |
| 4,057,757 | A | * | 11/1977 | Darden, Jr. | 455/90.3 |
| 4,520,979 | A | * | 6/1985 | McInnis | 248/323 |
| 4,715,293 | A | * | 12/1987 | Cobbs | 108/43 |
| 4,903,873 | A | * | 2/1990 | Poole et al. | 224/160 |
| 4,941,604 | A | * | 7/1990 | Nagareda | 224/160 |
| 4,956,937 | A | * | 9/1990 | Haddox | 47/67 |
| 5,016,797 | A | * | 5/1991 | Rowledge | 224/257 |
| 5,148,956 | A | * | 9/1992 | Funk | 224/576 |
| 5,505,353 | A | * | 4/1996 | Marsh, Jr. | 224/148.6 |
| 5,551,615 | A | * | 9/1996 | McIntosh | 224/270 |
| 5,639,004 | A | * | 6/1997 | Carlton et al. | 224/579 |
| 5,645,307 | A | * | 7/1997 | Wengler | 294/157 |
| 5,667,114 | A | * | 9/1997 | Bourque | 224/270 |
| 5,692,661 | A | * | 12/1997 | Kellerman | 224/648 |
| 5,724,225 | A | | 3/1998 | Hrusoff et al. | |
| 5,762,250 | A | | 6/1998 | Carlton et al. | |
| 5,887,777 | A | * | 3/1999 | Myles et al. | 224/578 |
| D410,335 | S | * | 6/1999 | Raich | D3/315 |
| 5,915,606 | A | * | 6/1999 | Jensen | 224/148.6 |
| 5,918,785 | A | * | 7/1999 | Irose | 224/259 |
| 5,938,096 | A | * | 8/1999 | Sauer et al. | 224/625 |
| 6,006,970 | A | | 12/1999 | Piatt | |

(Continued)

FOREIGN PATENT DOCUMENTS

| | | | |
|---|---|---|---|
| DE | 202004019191 | U1 | 4/2005 |

(Continued)

*Primary Examiner*—Nathan J Newhouse
*Assistant Examiner*—Peter Helvey
(74) *Attorney, Agent, or Firm*—Thomas A. Gallagher

(57) ABSTRACT

An easy to use notebook computer support system which will fit virtually any notebook or laptop computer. It has comfortable shoulder pads and allows access to all ports (front, back and side). In particular, it allows access data ports, power ports as well as disk drives. Significantly, the system according to the invention comprises only straps and little strap hardware so that it can fold up and fit into any type of laptop carrying case. Unlike other supports, the present invention does not block the ventilation fan(s) on the bottom of the computer.

11 Claims, 9 Drawing Sheets

U.S. PATENT DOCUMENTS

| | | | | |
|---|---|---|---|---|
| 6,137,675 | A | 10/2000 | Perkins | |
| 6,349,864 | B1 * | 2/2002 | Lee | 224/270 |
| 6,381,127 | B1 | 4/2002 | Maddali et al. | |
| 6,446,849 | B1 * | 9/2002 | Schleifer | 224/258 |
| 6,941,698 | B2 * | 9/2005 | Telles | 47/67 |
| 7,051,910 | B2 | 5/2006 | Sprague et al. | |
| 7,131,679 | B1 * | 11/2006 | Teran | 294/77 |
| 7,293,649 | B2 | 11/2007 | Gelphman et al. | |
| D558,974 | S * | 1/2008 | Denzer et al. | D3/215 |
| 2002/0100781 | A1 * | 8/2002 | Finkelstein | 224/264 |
| 2004/0011841 | A1 * | 1/2004 | Sprague et al. | 224/638 |
| 2006/0037987 | A1 * | 2/2006 | Lin | 224/646 |
| 2006/0231704 | A1 | 10/2006 | Storey et al. | |
| 2007/0235492 | A1 * | 10/2007 | Sirichai et al. | 224/930 |

FOREIGN PATENT DOCUMENTS

| | | |
|---|---|---|
| JP | 2004236267 | 11/2004 |

* cited by examiner

BODY SUPPORT FOR A PORTABLE COMPUTER

BACKGROUND OF THE INVENTION

1. Field of the Invention

The invention relates to a series of straps which are designed to fit over the back and shoulders of an operator and extend forward to support a laptop or notebook computer leaving both of the operator's hands free.

2. State of the Art

Laptop and notebook computers have become ubiquitous. As used herein, the terms laptop, notebook, and portable are interchangeable and relate to a computer which comprises two rectilinear parts coupled by a hinge, one part being the screen part and the other part being the keyboard part. These portable computers are used for a wide variety of tasks many of which are performed "in the field" and which require the operator of the computer to be standing without the benefit of a desk or other support for the computer. There is a recognized need to provide a support wearable by the operator to support a notebook computer.

U.S. Pat. No. 6,381,127 to Maddali et al. discloses a laptop computer support having a generally planar support base with shoulder straps attached to a leading edge of the support base and back straps attached to a trailing edge of the support base. The shoulder and back straps converge at a strap junction overlaying the user's back when the computer support is in use. The laptop computer support affords access to at least three sides of the laptop computer base wherein hardware/software ports are conventionally located, and the shoulder and back straps are configured so as to distribute the weight of a laptop computer evenly across the user's shoulders and back. The laptop computer is variably fixed to the support base with a hook and loop type fastener.

U.S. Pat. No. 6,006,970 to Piatt discloses a laptop computer harness having a left shoulder strap for providing support in front of a standing user of a left side of a laptop computer. An upper part of a single belt is attached at a point near a left rear corner of the laptop computer, then passes over the left shoulder and then under the left arm of the user, and with an attachment to attach a lower part of the strap to a left front corner of the laptop computer; a right shoulder strap for providing for the support in front of the user of a right side of the laptop computer; an upper part of a single belt is attached at a point near a right rear corner of the laptop computer, then passes over the right shoulder and then under the right arm of the user, and with an attachment to attach a lower part of the strap to a right front corner of the laptop computer. A chest webbing is provided for gathering the left shoulder strap to the right shoulder strap along a transverse line in front of the user's neck near the user's chest area. A back webbing is provided for gathering the left shoulder strap to the right shoulder strap along a transverse line in back of the user's neck near the user's shoulder-blade area. A rear clamp assembly is provided for mechanically securing the upper parts of the left and right shoulder straps to the left-rear and right-rear corners of the laptop computer. A front clamp assembly is provided for mechanically securing the lower parts of the left and right shoulder straps to the left-front and right-front corners of the laptop computer. A tensioner is provided for drawing the laptop computer taunt between the front and rear clamp assemblies.

There are yet other issued patents and published patent applications which disclose various types of supports for laptop/notebook computers. However, they all have disadvantages which were not apparent to their respective inventors.

SUMMARY OF THE INVENTION

The present invention provides an easy to use notebook computer support system which will fit virtually any notebook or laptop computer. It has comfortable shoulder pads and allows access to all ports (front, back and side). In particular, it allows access to data ports, power ports as well as disk drives. Significantly, the system according to the invention comprises only straps and little strap hardware so that it can fold up and fit into any type of laptop carrying case. Unlike other supports, the present invention does not block the ventilation fan(s) on the bottom of the computer. Thus, while the general need for a body support for a personal computer has been recognized, the prior art has not recognized the need for a body support which provides all of the advantages provided by the present invention.

According to the presently preferred embodiment, the body support includes two shoulder straps which extend over the operator's shoulders, crisscross over the operator's back and extend forward down toward the operator's waist. Thus, the shoulder straps have upper left and right ends and lower left and right ends. The four ends of the two shoulder straps are fitted with carabiners which are connected to five additional straps. Four of the five straps each have one end connected to an O-ring which, when the support is connected to a computer resides underneath the keyboard part of the computer in a generally central location. The other ends of the four O-ring connected straps are each coupled to one of the carabiners. The fifth strap is coupled to the upper left and right carabiners and extends from one shoulder strap to the other and under the keyboard portion of the computer and through the O-ring. The shoulder straps are preferably adjustable in length and have movable shoulder pads.

Additional objects and advantages of the invention will become apparent to those skilled in the art upon reference to the detailed description taken in conjunction with the provided figures.

DETAILED DESCRIPTION OF THE PRESENTLY PREFERRED EMBODIMENTS

Figure 1:
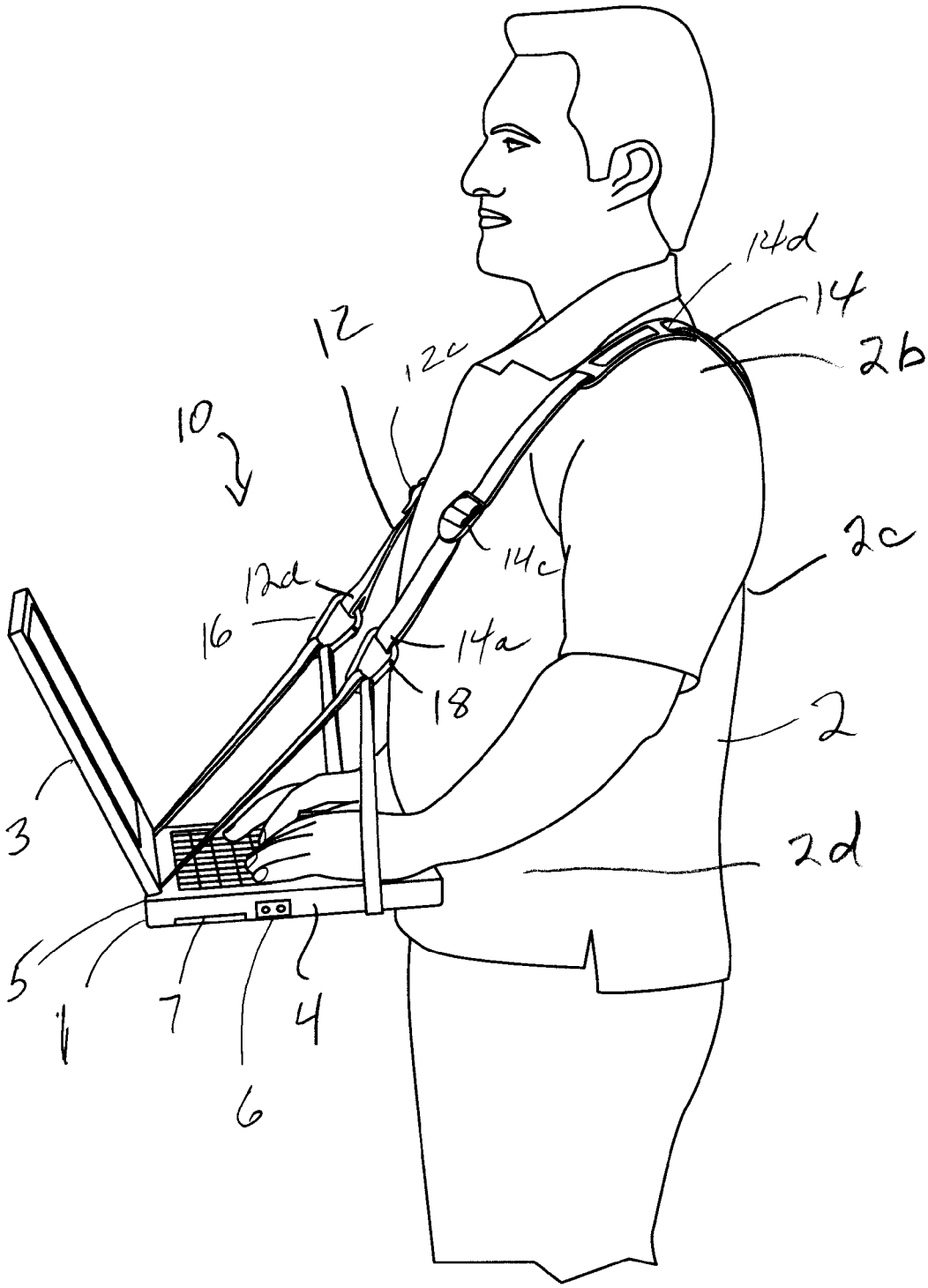
FIG. 1 is a broken side perspective view showing the invention worn by an operator and coupled to an opened notebook computer.
Figure 2:
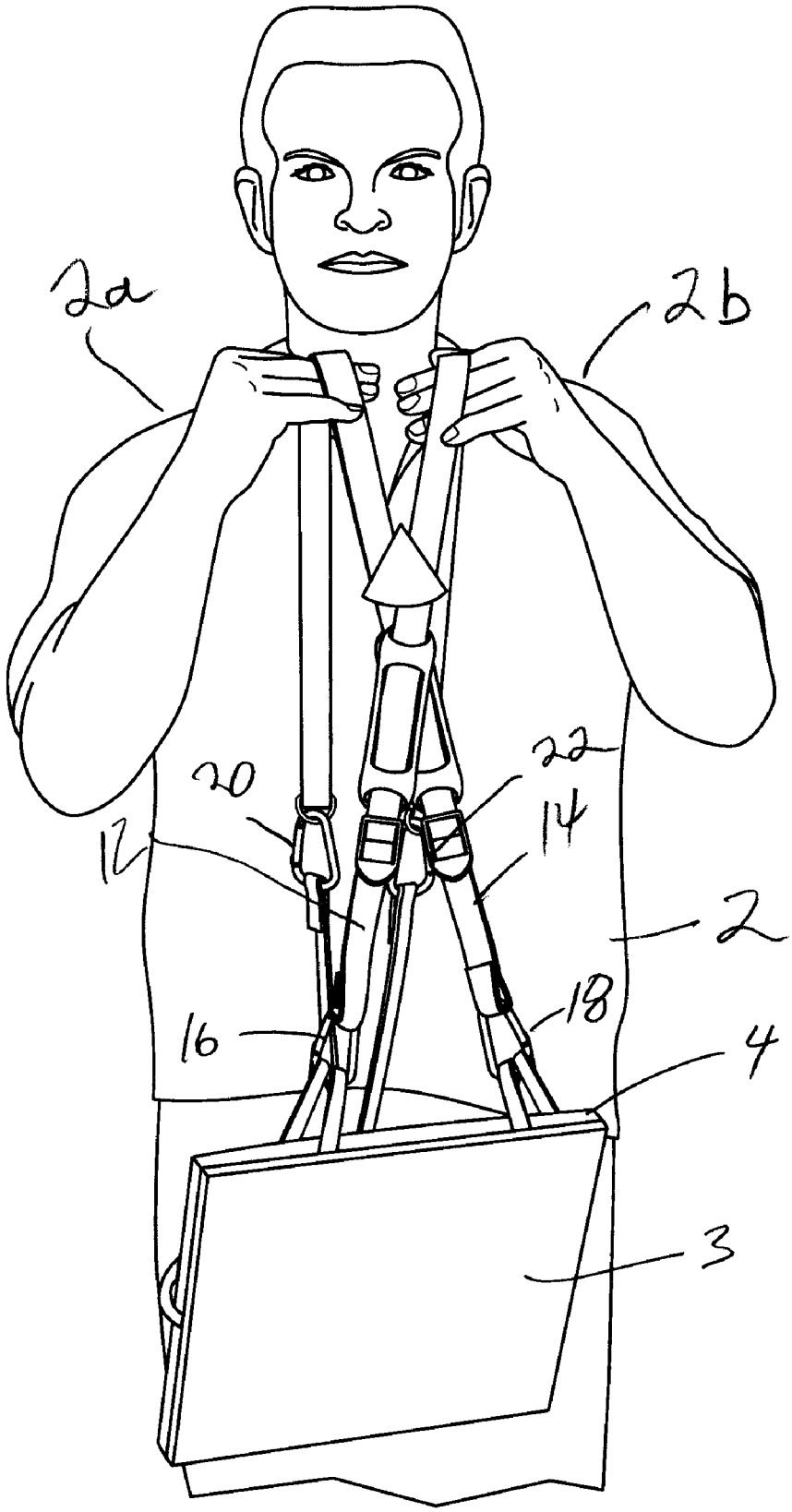
FIG. 2 is a broken front perspective view showing the invention coupled to a closed notebook computer but not yet worn by the operator.
Figure 3:
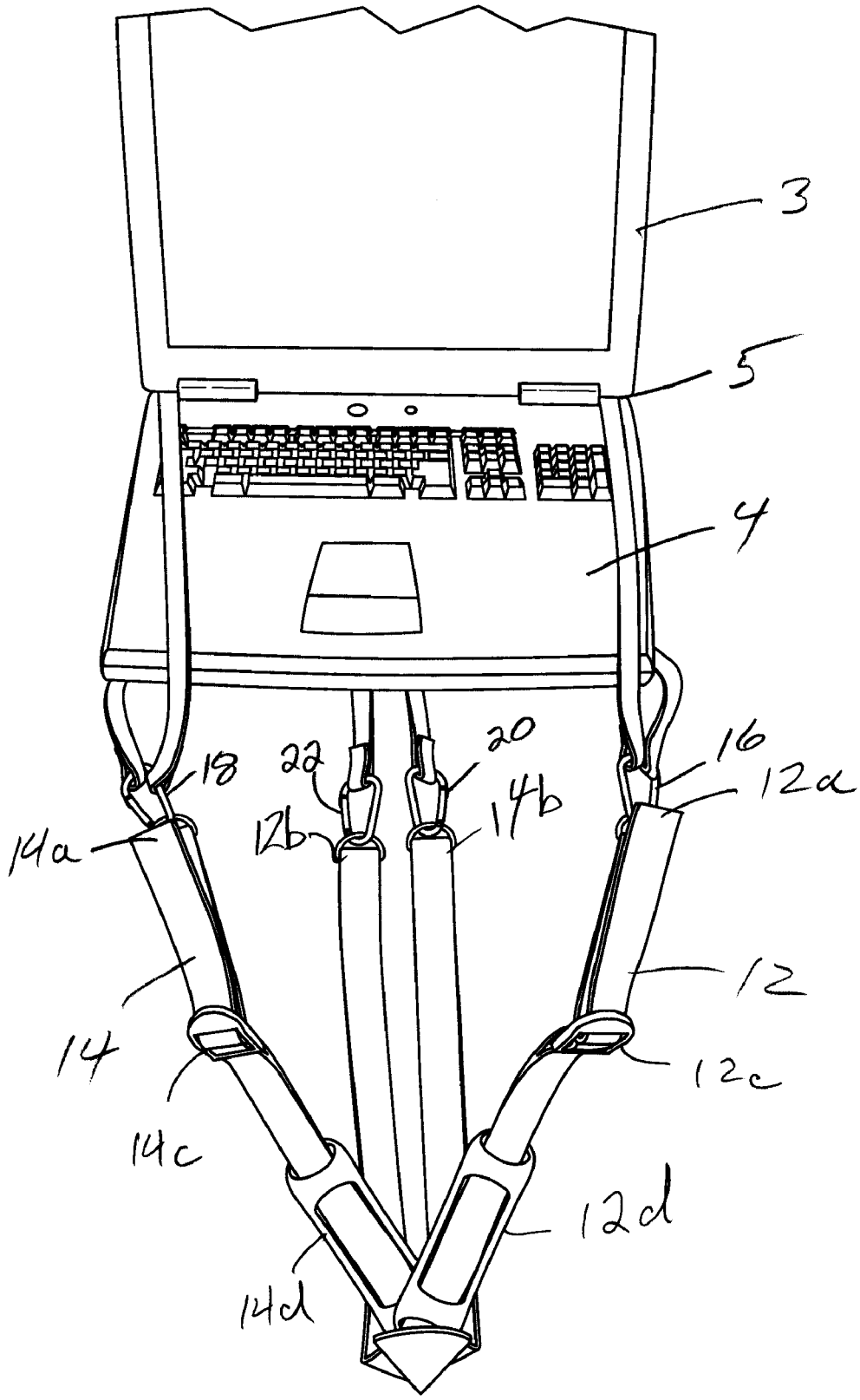
FIG. 3 is a broken perspective view showing the invention coupled to an opened notebook computer.
Figure 4:
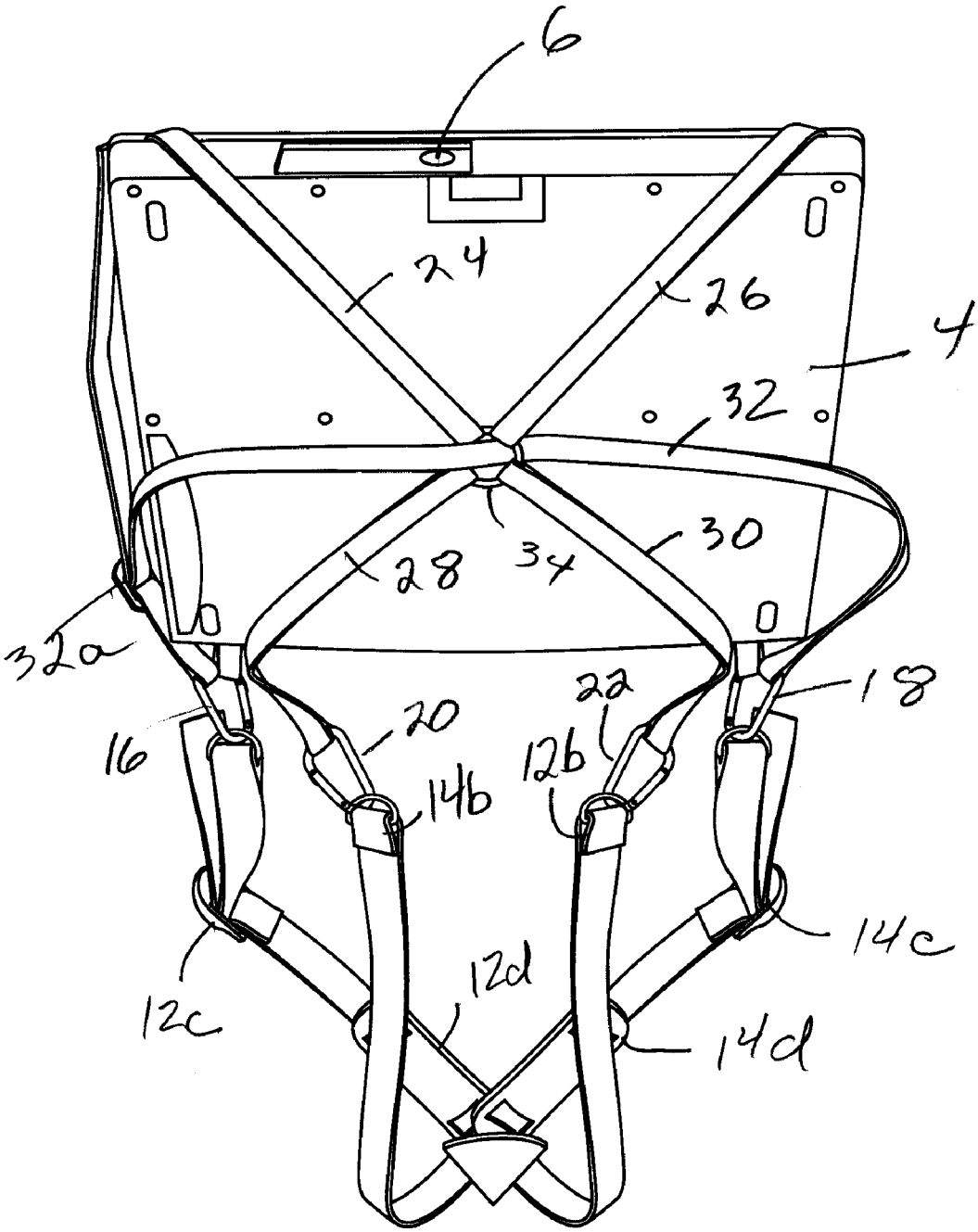
FIG. 4 is a bottom perspective view showing the invention coupled to a closed notebook computer.
Figure 5:
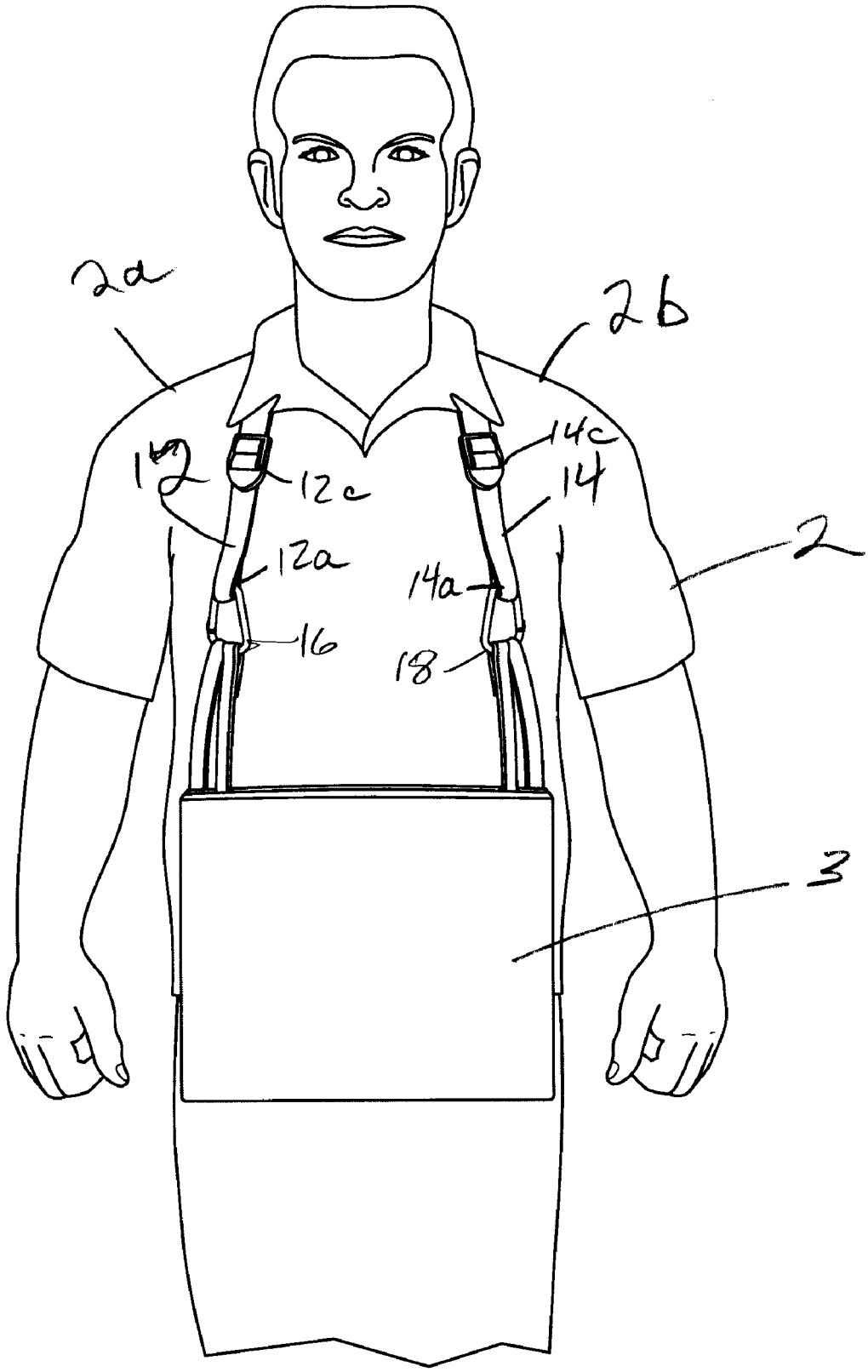
FIG. 5 is a broken front perspective view showing the invention worn by an operator and coupled to a closed notebook computer.
Figure 6:
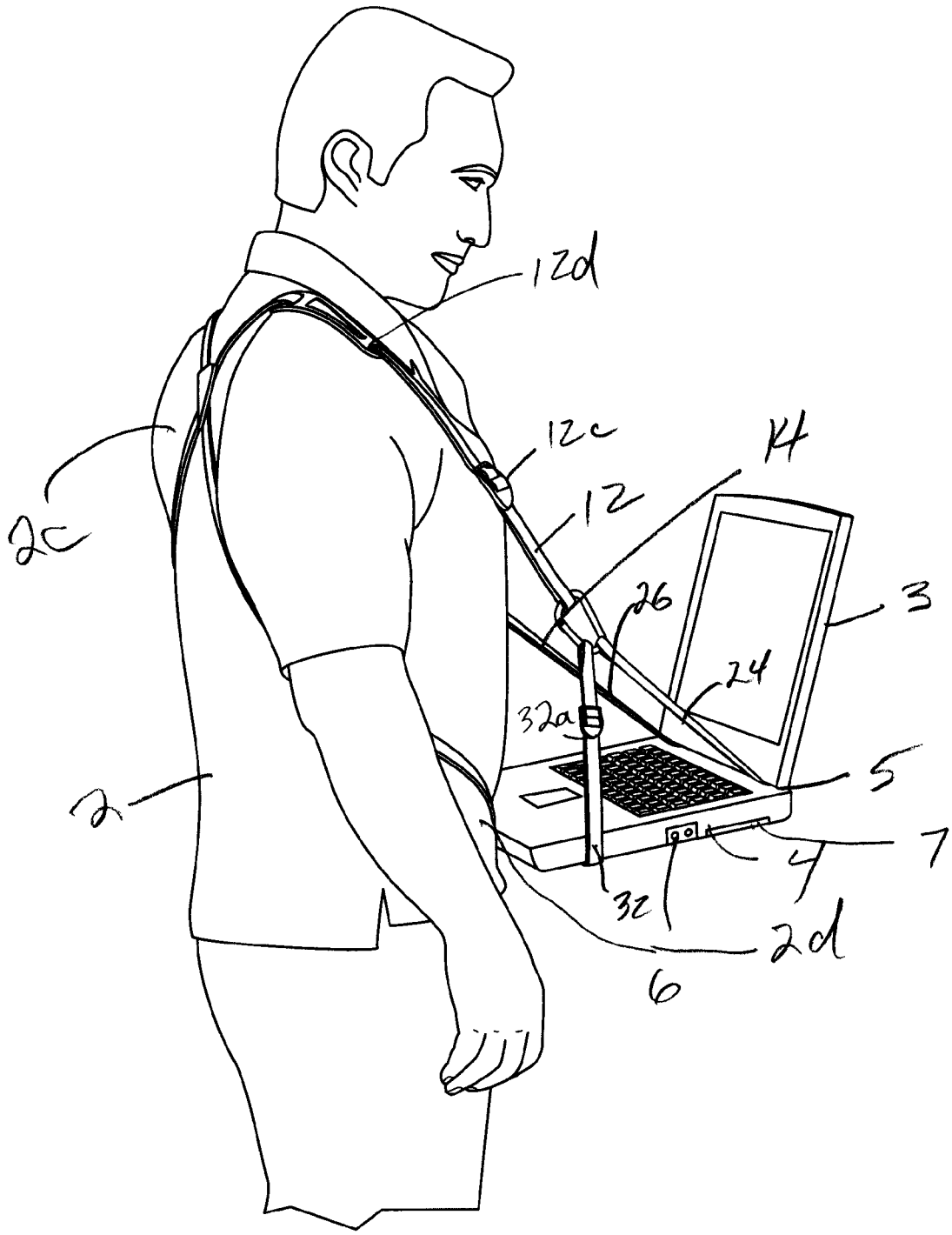
FIG. 6 is a broken side perspective view showing the showing the invention worn by an operator and coupled to an opened notebook computer.
Figure 7:
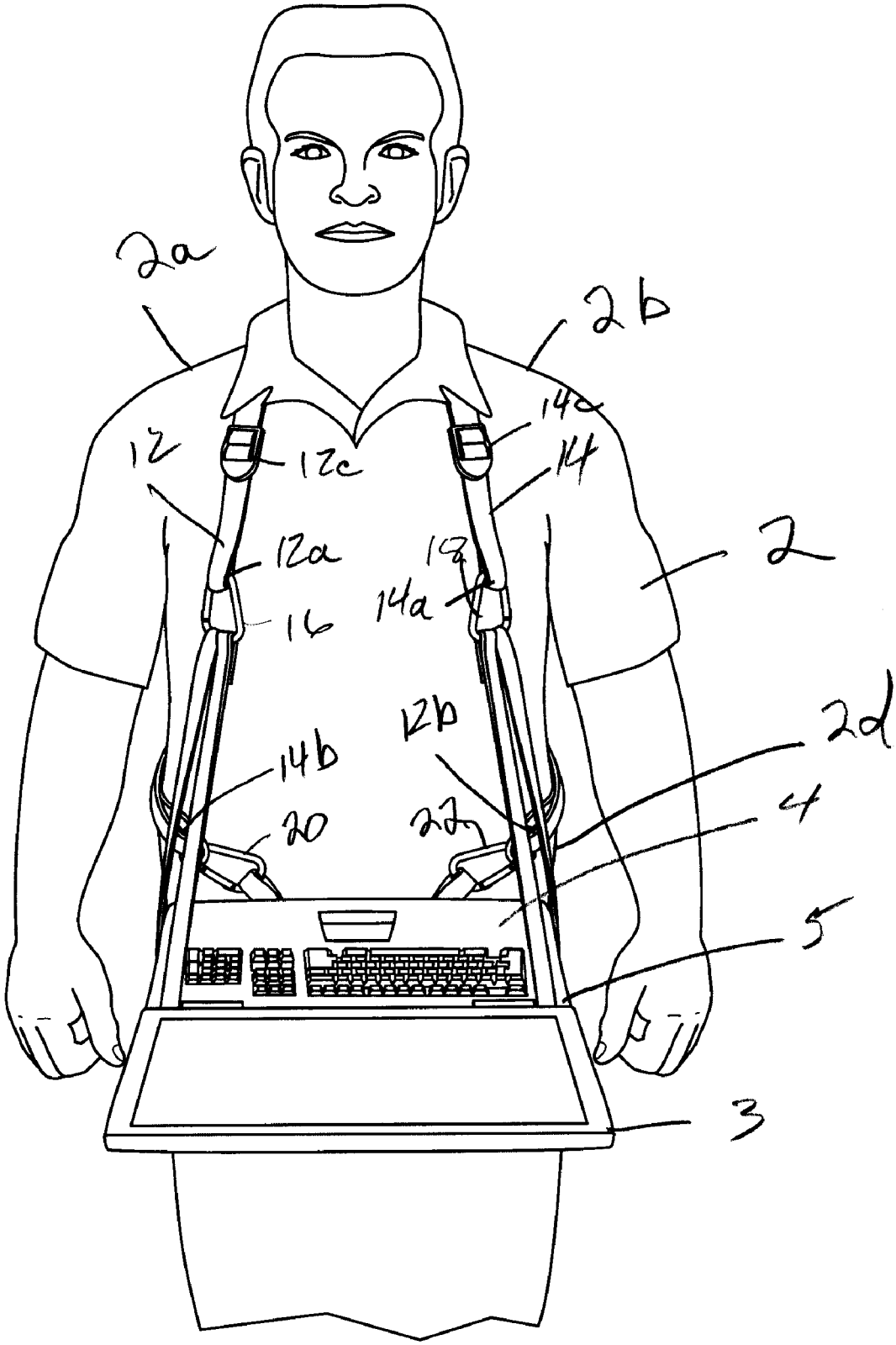
FIG. 7 is a broken front perspective showing the invention worn by an operator and coupled to a fully opened notebook computer.
Figure 8:
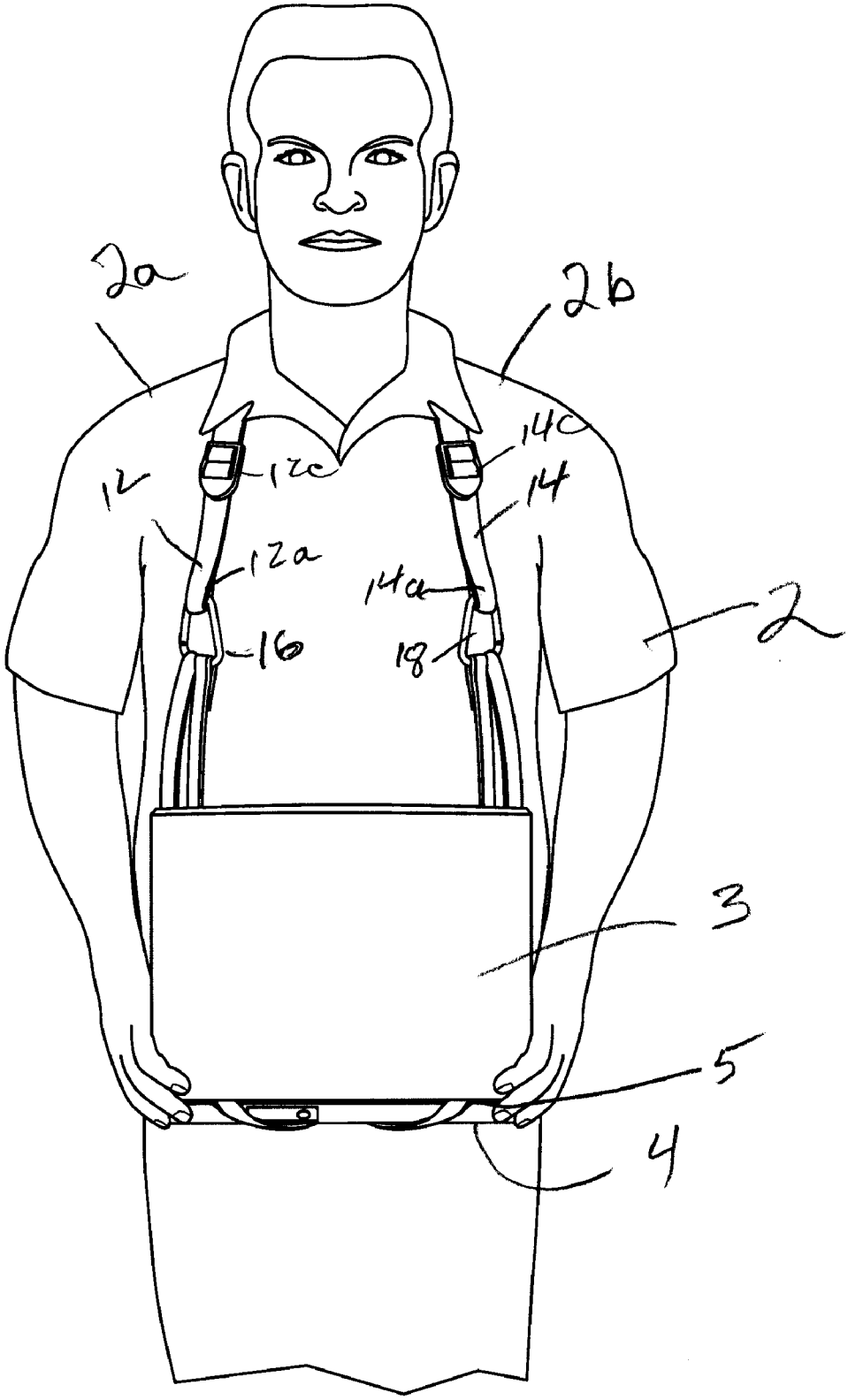
FIG. 8 is a broken front perspective showing the invention worn by an operator and coupled to a partially opened notebook computer.
Figure 9:
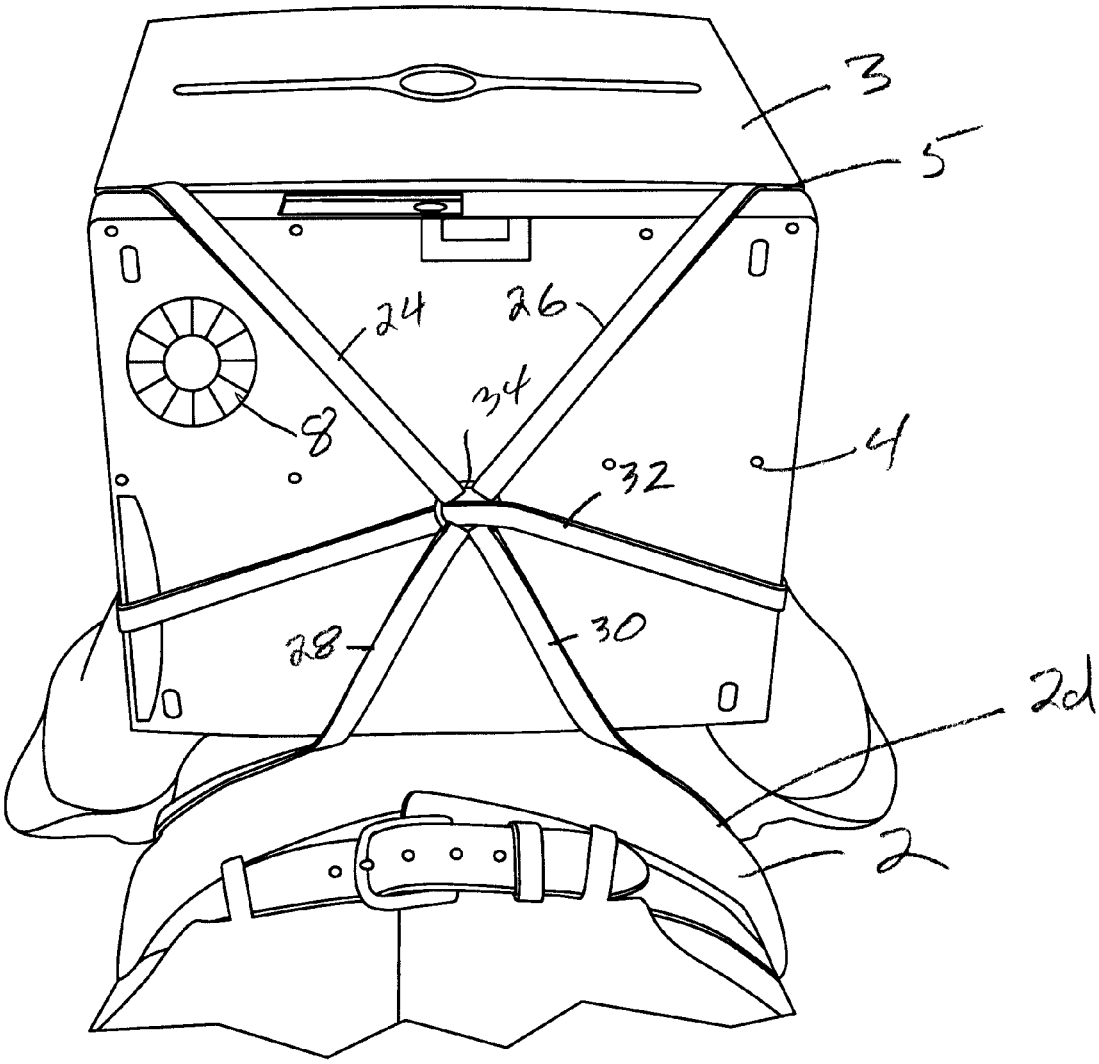
FIG. 9 is a broken bottom perspective showing the invention worn by an operator and coupled to a partially opened notebook computer.

Referring to the figures generally, the invention 10 is shown with a notebook computer 1 and an operator 2. The notebook computer has a screen part 3 and a keyboard part 4 which are hingedly coupled to each other leaving a smaller linear space 5 between them. Actually, the figures show several different notebook computers all of which are referred to with numerals 1, 3, 4, and 5. The computer shown in FIG. 1 has ports and a media slot 6, 7 on the left side. The computer shown in FIG. 4 has a port 6 on the rear. The computer shown in FIG. 6 has ports and a media slot 6, 7 on the right side. The computer shown in FIG. 9 has a ventilation fan 8 on the bottom.

The body support 10 includes two shoulder straps 12, 14 which extend over the shoulders 2*a*, 2*b* of the operator 2, crisscross over the operator's back 2*c* and extend forward down toward the operator's waist 2*d*. Thus, the shoulder straps have upper left and right ends 12*a*, 14*a* and lower left and right ends 12*b*, 14*b*. The four ends of the two shoulder straps are fitted with carabiners 16, 18, 20, 22 which are connected to five additional straps 24, 26, 28, 30, 32. Four of the five straps each have one end connected to an O-ring 34 which, when the support is connected to a computer resides underneath the keyboard part of the computer in a generally central location. The other ends of the four O-ring connected straps are each coupled to one of the carabiners. The fifth strap 32 is coupled to the upper left and right carabiners 16, 18 and extends from one shoulder strap to the other and under the keyboard portion of the computer and through the O-ring. The shoulder straps 12, 14 are preferably adjustable in length via buckles 12*c*, 14*c* and have movable shoulder pads 12*d*, 14*d*. The fifth strap 32 is preferably also adjustable in length via buckle 32*a*.

There have been described and illustrated herein a body support for a portable computer. While particular embodiments of the invention have been described, it is not intended that the invention be limited thereto, as it is intended that the invention be as broad in scope as the art will allow and that the specification be read likewise. For example, each strap may comprise multiple straps linked together. Carabiners may be replaced by equivalent hardware as so with the O-ring and the buckles. Though less preferred, the shoulder pads may be omitted. It will therefore be appreciated by those skilled in the art that yet other modifications could be made to the provided invention without deviating from its spirit and scope as claimed.

What is claimed is:

1. A body support for a portable computer having a rectilinear footprint, comprising:

two shoulder straps which are arranged to extend over the operator's shoulders, crisscross over the operator's back and extend forward down toward the operator's waist, the shoulder straps defining upper left and right ends and lower left and right ends;

four carabiners, one coupled to each of the upper left and right ends and lower left and right ends;

five additional straps, said four carabiners being coupled to said five additional straps, said five additional straps being arranged to support the rectilinear bottom of the portable computer without the aid of a platform, said support supporting the portable computer in both an opened and a closed position;

a ring;

one end of each of the four of said five additional straps being coupled to said ring.

2. The support according to claim 1, wherein:

the fifth of said five additional straps is coupled at one end to the upper left carabiner and at the other end to the upper right carabiner.

3. The support according to claim 2, wherein:

the fifth of said five additional straps comprises two parts coupled by an adjustable buckle.

4. The support according to claim 1, wherein:

each of said two shoulder straps comprises two parts coupled by an adjustable buckle.

5. The support according to claim 1, wherein:

each of said two shoulder straps has a movable shoulder pad.

6. The support according to claim 2, wherein:

the fifth of said five additional straps passes through said ring.

7. The support according to claim 1, wherein:

no part of said support inhibits ventilation of the computer when the support is in use with a computer.

8. The support according to claim 1, wherein:

no part of said support inhibits access to a removable memory medium when the support is in use with a computer.

9. The support according to claim 1, wherein:

each one of said four carabiners is directly connected to one of said upper left and right ends and lower left and right ends.

10. A portable computer and body support system, comprising:

a portable computer having a rectilinear footprint;

a plurality of straps arranged to extend over the operator's shoulders, crisscross over the operator's back and extend forward down toward the operator's waist, said straps supporting the rectilinear bottom of the portable computer without the aid of a platform and without blocking or impairing ventilation to the portable computer, wherein said plurality of straps include two shoulder straps which are arranged to extend over the operator's shoulders, crisscross over the operator's back and extend forward down toward the operator's waist, the shoulder straps defining upper left and right ends and lower left and right ends;

four carabiners, one coupled to each of the upper left and right ends and lower left and right ends;

four additional straps, said four carabiners being coupled to said four additional straps, said four additional straps being arranged to support the rectilinear bottom of the portable computer;

a ring;

one end of each of said four additional straps being coupled to said ring.

11. The system according to claim 10, wherein:

no part of said support inhibits access to a removable memory medium in the computer.

* * * * *